US008357208B2

(12) United States Patent
Takagi et al.

(10) Patent No.: US 8,357,208 B2
(45) Date of Patent: Jan. 22, 2013

(54) METHOD FOR PRODUCING MODIFIED ANIMAL FIBER

(75) Inventors: Akinori Takagi, Osaka (JP); Susumu Katsuen, Osaka (JP); Kunihiro Ohshima, Osaka (JP)

(73) Assignee: Kurashiki Boseki Kabushiki Kaisha, Okayama (JP)

( * ) Notice: Subject to any disclaimer, the term of this patent is extended or adjusted under 35 U.S.C. 154(b) by 2 days.

(21) Appl. No.: 13/063,375

(22) PCT Filed: Jun. 23, 2010

(86) PCT No.: PCT/JP2010/060654

§ 371 (c)(1), (2), (4) Date: Mar. 10, 2011

(87) PCT Pub. No.: WO2011/030599

PCT Pub. Date: Mar. 17, 2011

(65) Prior Publication Data

US 2011/0191963 A1 Aug. 11, 2011

(30) Foreign Application Priority Data

Sep. 11, 2009 (JP) ..... 2009-210581

(51) Int. Cl.
*D01C 3/00* (2006.01)

(52) U.S. Cl. ..... 8/111; 8/128.1

(58) Field of Classification Search ..... 8/111, 112, 8/128.1

See application file for complete search history.

(56) References Cited

U.S. PATENT DOCUMENTS

2002/0032930 A1* 3/2002 Ichimura et al. ..... 8/94.15

FOREIGN PATENT DOCUMENTS

| | | | |
|---|---|---|---|
| JP | 50-126997 | | 10/1975 |
| JP | 03-019961 | | 1/1991 |
| JP | 2001164460 | * | 6/2001 |
| JP | 2002-105851 | | 4/2002 |
| JP | 2004-162220 | | 6/2004 |
| JP | 3683879 | B2 | 6/2005 |
| JP | 3722708 | B2 | 9/2005 |

OTHER PUBLICATIONS

Translation JP2001-164460 Jun. 2001 Kazuhiro et al.*

Eriksson et al. Reaction of SDS with Ozone and OH Radicals in Aqueous Solution. Ozone: Science and Engineering, 29: 131-138 Mar.-Apr. 2007.*

* cited by examiner

*Primary Examiner* — Lorna M Douyon
*Assistant Examiner* — Amina Khan
(74) *Attorney, Agent, or Firm* — Hamre, Schumann, Mueller & Larson, P,C.

(57) ABSTRACT

Disclosed is a method for producing a modified animal fiber, the method includes step 1 (31, 32) of pre-oxidizing a cystine bond (—S—S— bond) present in an epidermal cell of an animal fiber to bring the cystine bond into a low oxidation state, step 2 (33) of oxidizing with ozone the pre-oxidized —S—S— bond to bring the —S—S— bond into at least one high oxidation state selected from di-, tri-, and tetra-oxidation states, and step 3 (34) of reductively cleaving the —S—S— bond in a high oxidation state. The method imparts shrink resistance and pilling resistance to an animal fiber. In the step 2 (33) ozone is microdispersed in an aqueous solution comprising an anionic surfactant having a $C_{8-24}$ alkyl group, and the animal fiber is contacted with the ozone. Accordingly, the present invention provides a method for efficiently producing in a short period of time an animal fiber having excellent shrink resistance that barely undergoes felting when washed in an aqueous system in shrink proofing an animal fiber using ozone.

7 Claims, 3 Drawing Sheets

METHOD FOR PRODUCING MODIFIED ANIMAL FIBER

TECHNICAL FIELD

The present invention relates to a method for producing an animalliber provided with shrink resistance and pilling resistance. In particular, the present invention relates to a method for producing an animal fiber provided with shrink resistance and pilling resistance without compromising the excellent natural water repellence of an animal fiber.

BACKGROUND ART

Animal fibers are unique in that, depending on the type of fiber, they have a characteristic texture, are biodegradable, exhibit excellent moisture absorbing, moisture releasing, heat retaining, flame retarding, and dyeing properties, and further have water repelling properties. In terms of physical properties, animal fibers have fiber strength and elongation characteristics sufficient for being worn and also exhibit high frictional strength, and thus are unique fibers that have been valued since ancient times. However, felting that occurs due to the epidermal tissue structure of an animal fiber when the fiber is washed, and pilling that occurs when an animal fiber is worn, are not desirable characteristics of fiber for use in garments. Accordingly, efforts have long been made to modify the surface, focusing mainly on shrink proofing, and in association with this an anti-pilling treatment has been carried out as well.

However, water repellence, a natural feature of animal fiber, is sacrificed in animal fiber obtained in such a manner. The water repellent membrane in an animal fiber influences moisture absorbing and moisture releasing properties, functions to control heat transfer associated with the adsorption and desorption of water, and affects heat retention and comfort. In other words, conventional shrink resistant products can prevent shrinking resulting from washing but lack heat retention and comfort.

An example of a typical conventional shrink proofing method is a shrink proofing method that uses a chlorine agent in which the epidermal tissue of an animal fiber is made hydrophilic to soften or remove the tissue so as to give shrink resistance and, moreover, the epidermal tissue is coated with a polyamide epichlorohydrin resin (manufactured by Dick Hercules Co., Hercosett resin) to enhance washing resistance, i.e., the chlorine/Hercosett shrink proofing method. This method is currently in widespread use all over the world and arguably is regarded as the standard shrink proofing process for wool.

The applicants proposed shrink proofing that uses ozone in the following patent documents 1 to 2 as an alternative to the chlorine/Hercosett shrink proofing process.

CITATION LIST

Patent Documents

Patent Document 1: Japanese Patent No. 3722708
Patent Document 2: Japanese Patent No. 3683879

SUMMARY OF INVENTION

Technical Problem

However, this method also was still problematic in that felting shrinkage occurred while carrying out washing in an aqueous system and reactivity needed to be enhanced.

The present invention provides a method for efficiently producing in a short period of time an animal fiber having excellent shrink resistance that is unlikely to felt when washed in an aqueous system in shrink proofing of an animal fiber using ozone.

Solution to Problem

The method for producing a modified animal fiber of the present invention includes step 1 of pre-oxidizing a cystine bond (—S—S— bond) present in an epidermal cell of an animal fiber to bring the cystine bond into a low oxidation state, step 2 of oxidizing with ozone the pre-oxidized —S—S— bond to bring the —S—S— bond into at least one high oxidation state selected from di-, tri-, and tetra-oxidation states, and step 3 of reductively cleaving the —S—S— bond in a high oxidation state. The method imparts shrink resistance and pilling resistance to an animal fiber. In the step 2, ozone is microdispersed in an aqueous solution containing an anionic surfactant having a $C_{8-24}$ alkyl group, and the animal fiber is contacted with the ozone.

Advantageous Effects of Invention

In the present invention, in the foregoing step 2, ozone is microdispersed in an aqueous solution containing an anionic surfactant having a $C_{8-24}$ alkyl group and the animal fiber is treated with the ozone, and accordingly the present invention provides a method for efficiently producing in a short period of time an animal fiber having excellent shrink resistance that is unlikely to felt when washed in an aqueous system.

DESCRIPTION OF EMBODIMENTS

Figure 1:
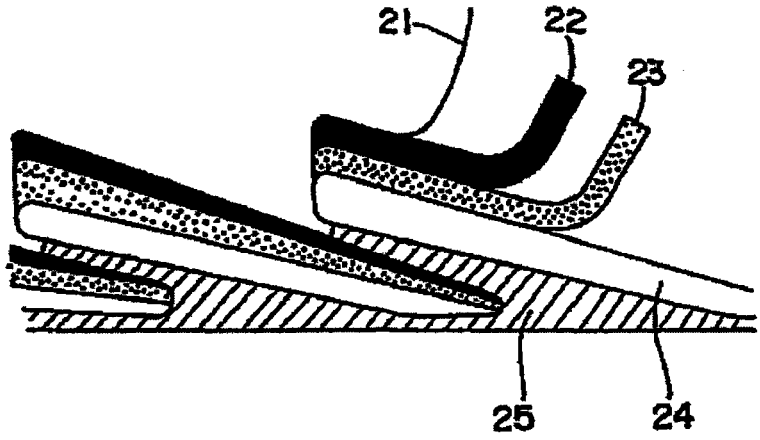
FIG. 1 is a schematic longitudinal sectional view of an animal fiber.

Hereinafter, the mechanism of shrink resistance and pilling resistance of the present invention shall be described using the structure of wool as an example. FIG. 1 is a schematic longitudinal sectional view of the surface portion of a wool fiber taken from Wool Science Review Vol. 63 (1986). In the epidermal tissue (cuticle) portion called scales, an epicuticle layer (21), an exocuticle layer A (22), an exocuticle layer B (23), and the innermost layer, i.e., an endocuticle layer (24), are arranged in this order from the outside. Moreover, the outer surface of the epicuticle layer is covered with a layer having a thickness of about 0.9 nm of higher fatty acids (mainly eicosanic acid) bonded via a thioester bond with the —SH residue of the polypeptide chain in the epicuticle layer, and the alkyl group of the eicosanic acid provides the animal fiber with excellent water repellency.

More specifically, higher fatty acids, especially eicosanic acid, having water repellency that constitute the outermost surface of the fiber are connected to the epicuticle layer (12 wt % cystine content) via a thioester bond, and the epicuticle layer forms a structure integral with the exocuticle layer A (35 wt % cystine content) located immediately below, thus accounting for a thickness of about 20% of the entire thickness of the epidermis (cuticle), and in this tissue, cystine bonds are distributed in a high concentration reaching about 70 wt % of the entire cystine content of the epidermis (cuticle). The remaining 30 wt % or so is known to be the exocuticle layer B (15 wt % cystine content) and the endocuticle layer (3 wt % cystine content).

The epidermal tissue is mostly composed of the exocuticle layers A and B and the endocuticle layer, but since the exocuticle layer A forms a tissue structure integral with the epicuticle layer, a felting phenomenon occurs in a manner substantially dependent on the exocuticle layer B and the endocuticle layer.

When a wool fiber is immersed in water, the respective layers absorb water to varying degrees and swell, and naturally the greater the cysteine crosslink developed, the smaller the extent of swelling caused by water. Therefore, when a fiber is immersed in water, the innermost endocuticle layer, which has a low cysteine crosslink density, undergoes water swelling and elongates while the outer exocuticle layers, which have a high cysteine crosslink density, undergo less water swelling and therefore the extent of elongation is smaller. Due to such a difference in elongation caused by swelling, the edge of the scales lifts up, resulting in entanglement of fibers and felting. In detail, individual fibers become entangled with each other, the entangled portion becomes further entangles with other fibers due to the external force applied to a garment during washing, and the fibers as a whole are drawn toward the entangled portion, thus shrinking the length of the entire fiber mass and resulting in felting. Therefore, felting is accompanied by shrinking.

The animal fiber that has excellent shrink resistance and pilling resistance of the present invention is attained chiefly by chemically modifying the epidermal tissue. That is, the lifting of the scales when a fiber is immersed in water substantially is eliminated by substantially equalizing the swellability of the exocuticle layer B with that of the endocuticle layer while the water repellency provided by eicosanic acid in the outermost surface is maintained.

That is, mainly only the exocuticle layer B is selectively attacked to collapse the crosslink structure including the cystine bond, while preserving the integral structure of the epicuticle layer/exocuticle layer A that is histologically rigid, and while therefore also preserving the water-repellent eicosanic acid. Since only the portion in the surface layer of the fiber, particularly the portion involved in swelling and shrinking, is modified and the interior of the fiber remains intact, not only is the water repellence of the entire fiber maintained but also the strength of the fiber is preserved.

The foregoing structural change brought about by the treatment of the present invention can be checked by reflection FT-IR measurement (ATR method). In connection with the FT-IR absorbance of an animal fiber that has been subjected to the modification treatment, for both the absorption band at 1040 $cm^{-1}$ corresponding to a $SO_3H$ group (sulfonate group) and the absorption band of 1024 $cm^{-1}$ corresponding to a S—$SO_3Na$ group (Bunte salt), the relative absorbance with the absorption band corresponding to amide I (1650 $cm^{-1}$) being 1 is higher than the relative absorbance of an untreated animal fiber, showing that the crosslink of the exocuticle layer B is cleaved.

On the other hand, in an animal fiber obtained according to a typical conventional shrink proofing, i.e., a chlorine treatment method or a chlorine/Hercosett method, the integral structure of the epicuticle layer/exocuticle layer A is attacked directly, resulting in severe damage particularly to the epicuticle layer, and thus the water repellent layer is destroyed and water repellence, which is a feature naturally found in an animal fiber, is compromised. In addition, the entire fiber is oxidized, resulting in impaired strength. Moreover, the scale surface of a conventional shrink-resistant animal fiber is smooth and the frictional resistance produced when a single fiber is pulled out is lower than that of the animal fiber of the present invention in which scales are preserved, and thus the conventional fiber fails to exhibit sufficient pilling resistance.

This can be readily determined by dripping about 1 ml of water onto a knitted fabric. First, a droplet of water remains as is on untreated wool after a lapse of 30 minutes from dripping. This is due to the water repellence of the epicuticle layer. With respect to an animal fiber that has been subjected to a typical conventional shrink proofing, i.e., a chlorine treatment method or a chlorine/Hercosett method, a droplet of water mostly permeates a knitted fabric within 2 minutes of dripping and completely permeates in 30 minutes. In contrast, the behavior (water repellence) of a droplet on the treated product of the present invention is nearly identical to that of untreated wool. It thus can be confirmed that the surface state of natural wool can be maintained by the method of the present invention.

Examples of animal fibers for use in the present invention include wool, mohair, alpaca, cashmere, llama, vicuna, camel, and angora.

The highly shrink-resistant animal fiber that has the foregoing features of the present invention can be produced according to the production method of the present invention described below.

In step 1 of the present invention, a pre-oxidation treatment is performed on the cystine bond present in the epidermal cell of an animal fiber to bring the cystine bond into a low oxidation state. That is, the cystine bond is in a pre-oxidized state, i.e., in a low oxidation state. Specifically, the cystine bond is brought into a mono-oxidized (—SO—S—) or di-oxidized (—$SO_2$—S—) form or into a mixed state including these forms. In particular, the cystine bond is rendered rich in a mono-oxidized state. Examples of oxidizing agents preferable for pre-oxidation include persulfuric acid, peracetic acid, performic acid, neutral and acid salts of these peroxy acids, potassium permanganate, and hydrogen peroxide, and these may be used singly or as a combination of two or more. A particularly preferable oxidizing agent is potassium hydrogen persulfate.

In step 2 of the present invention, the pre-oxidized —S—S— bond is subjected to an oxidizing treatment to attain one or more high oxidation states of di-, tri-, and tetra-oxidation states. The high oxidation state refers to a state including a di-oxidized, tri-oxidized (—$SO_2$—SO—), or tetra-oxidized (—$SO_2$—$SO_2$—) form, or a mixed state including these forms. It is known that it is difficult to cleave the —S—S-bond in a mono-oxidation state with a reducing agent and it takes a long period of time but the bond in a di-, tri-, or tetra-oxidation state is cleaved relatively easily, so the bond is brought into a predominantly di-, tri-, or tetra-oxidation state.

In step 2, ozone is microdispersed in an aqueous solution containing an anionic surfactant having a $C_{8-24}$ alkyl group and an animal fiber is treated with ozone. The surfactant is resistant to ozone degradation and suitable for microdispersing ozone. Ozone once microdispersed exhibits enhanced reactivity with an animal fiber and felting is less likely to occur during washing of the animal fiber in an aqueous system, thereby allowing the duration of immersing the animal fiber in an aqueous ozone solution to be shortened. Accordingly, the exocuticle layer B portion is preferentially and promptly oxidized with ozone to attain a high oxidation state. The amount of the anionic surfactant present in the aqueous solution preferably is in a range of 0.01 to 0.1 wt %. Stable processing can be performed if the amount is within this range. The processed product is unlikely to felt even when being washed in an aqueous system.

It is preferable that the surfactant is an anionic surfactant containing at least one alkaline metal salt of a hydrophilic group selected from a sulfonic acid ($R—SO_3H$ wherein R is a $C_{8-24}$ alkyl group), a carboxylic acid (R—COOH wherein R is a $C_{8-24}$ alkyl group), a sulfuric acid ester of an alcohol ($R—O—SO_3$ wherein R is a $C_{8-24}$ alkyl group), and a phosphoric acid ester ($R_1O—P(O)(OR_2)(OX)$ wherein $R_1$ is a $C_{8-24}$ alkyl group, $R_2$ is a $C_{8-24}$ alkyl group or a hydrogen atom, and X is a hydrogen atom). More specific examples include linear saturated fatty acid salts having a $C_{8-24}$ alkyl group, branched fatty acid salts having a $C_{8-24}$ alkyl group, $C_{8-24}$ linear or branched alkyl sulfate salts, $C_{8-24}$ linear alkylbenzene sulfonate salts, $C_{8-24}$ branched alkylbenzene sulfonate salts, $C_{8-24}$ linear or branched alkyl sulfonate salts, and $C_{8-24}$ mono- or dialkyl phosphate salts. More preferably, the surfactant is sodium dodecyl sulfate ($C_{12}H_{25}OSO_3Na$).

In the present invention, the diameter of the bubbles of the ozone may be in a range of 0.5 to 3 μm. It is preferable that the apparent amount of the ozone supplied to the animal fiber is 1.5 to 4% owf (owf stands for "on the weight of fiber"). The diameter of ozone bubbles as mentioned above may be measured according to the laser diffraction/scattering method.

Step 3 in the present invention is for reductively cleaving the —S—S— bond that is in a di-, tri-, or tetra-oxidation state. For example, a sulfurous acid salt is used as a reducing agent. Accordingly, the animal fiber is subjected to a reduction treatment to cleave the cystine (—S—S—) bond, reduce the cystine crosslink density of the exocuticle layer B, promote swelling, fluidization and solubilization in water, and partially remove protein out of the fiber.

According to the method of the present invention, the cystine crosslink density of the exocuticle layer B is reduced by performing prior oxidation (pre-oxidation), ozone oxidation (high oxidation), and a reduction treatment with a sulfurous acid salt so as to attain water swellability that is comparable to that of endocuticle and eliminate the bimetal-like behavior between the exocuticle layer B and the endocuticle layer, and therefore the edge of scales does not lift up even when the resulting animal fiber is immersed in water, and shrinking does not occur. Moreover, since the epicuticle layer and the eicosanic acid thioester layer that covers the surface of the epicuticle layer are still preserved, a high degree of shrink resistance is provided without impairing water repellence. Moreover, since scales on the fiber are preserved, the frictional resistance produced when pulling out a single fiber is higher than that of fibers treated by a shrink proofing method in which scales are removed or by a shrink proofing method in which the scale surface is coated with a resin, and thus movement of fibers is inhibited, resulting in little pilling.

The animal fiber obtained according to the method of the present invention, in particular, retains excellent water repellency as naturally found in an animal fiber and has markedly superior shrink resistance and pilling resistance. The shrink resistance of an animal fiber can be expressed using felting shrinkage or a single-fiber frictional coefficient difference as one measure. In the case where the shrink resistance is expressed in felting shrinkage, the animal fiber of the present invention can exhibit an area shrinkage of 10% or less as a 10-hour value. More preferably it is 5% or less and particularly preferably 3% or less. In the case where the shrink resistance is expressed as a single-fiber frictional coefficient value, the difference ($\mu_a$-$\mu_w$) between a value obtained in the tip to root direction ($\mu_a$) and a value obtained in the root to tip direction ($\mu_w$) relative to the direction of the scale preferably is lower by at least 30% and more preferably at least 40% than the untreated animal fiber as a value expressing the coefficient of static friction or a value expressing the coefficient of dynamic friction. In addition, the value $\mu_a$ is comparable to that of the untreated animal fiber, and the value $\mu_w$ is greater by at least 30% than that of the untreated animal fiber.

The single-fiber frictional coefficient is measured according to JIS L 1015 and measurement is carried out under the following conditions:

(1) Tester: Roder frictional coefficient tester (2) Hanging line load: 200 mg (3) Cylinder circumferential velocity: 90 cm/min (4) "$\mu_a$" refers to a frictional coefficient in the tip to root direction relative to the scale and "$\mu_w$" refers to a frictional coefficient in the root to tip direction relative to the scale.

Presence of the surface epicuticle layer that provides an animal fiber with water repellency can be checked also by generation of bubbles on the surface through an Allworden reaction (Wool Science Review, Vol. 63 (1986)) in which animal fibers are immersed in saturated chlorine water or saturated bromine water.

In one embodiment, in the present invention, a sliver composed of an animal fiber is, first, subjected to a pad-steam treatment for pre-oxidation using an oxidizer that has an ability to oxidize the cystine —S—S— bond of the animal fiber without a chlorinating agent or a chlorine-containing resin; ozone-oxygen mixed gas is processed into ultrafine bubbles having a diameter ranging from 0.5 to 5 μm, and preferably a diameter of 0.5 to 3 μm, in water using a line mixer and allowed to collide against the previously pre-oxidized animal fiber for a specific duration to cause a gas-phase oxidation reaction in the solution, so the cystine bond of wool is oxidized and the cystine bond is brought into a high oxidation state; and a reduction treatment is performed on the highly oxidized animal fiber to cleave the cystine bond.

Pre-oxidation is carried out generally through a pad (impregnation)-steam (reaction) method, or in some cases by a pad-store (reaction at room temperature) method. Usually, when potassium hydrogen persulfate is used, an immersion method is adopted, and in this case a treatment agent permeates the fiber, and the (entire) fiber is oxidized and hydrolyzed and the cystine bond is cleaved, resulting in impairment of strength, elongation and similar physical properties. Nevertheless, a shrink resisting effect is not obtained. Moreover, in a method in which potassium hydrogen persulfate is padded (impregnated) and stored (being left at room temperature), a reaction with the fiber does not occur and the epidermis is not oxidized sufficiently unless the reaction temperature is at room temperature or greater (substantially 32° C. or higher). The treatment conditions need to be configured according to the type of oxidizer used and the reactivity of the oxidizer with the fiber. In the case of using potassium hydrogen persulfate, however, the pad (impregnation)-steam (thermal reaction) method oxidizes only the cystine bond present in the epidermal portion while preventing the inner portions of the fiber from being oxidized, thereby making it easy to subsequently bring the epidermal portion into a high oxidation state with ozone.

In this pre-oxidation step, first, the exocuticle layer B is pre-oxidized (step 1). Compared with the tissue of the exocuticle layer B, the tissue of the epicuticle layer and the exocticle layer A that is in contact with the epicuticle layer has a very high cystine crosslink density and therefore is very rigid and exhibits chemical resistance and abrasion resistance. The tissue that is eventually decomposed by hydrolysis with 6N-hydrochloric acid is the epicuticle portion. Therefore, histologically, the epicuticle is treated as a resistant membrane. Accordingly, the exocuticle layer B is relatively more likely to undergo oxidation than the epicuticle layer and the exocuticle layer A.

That is, in step 1 in the present invention, a wetting agent is placed in a bath supplied with an aqueous oxidizer solution, the bath temperature is controlled as much as possible to be no greater than room temperature, padding (impregnation) is performed such that the duration of contact between the animal fiber and the solution is a few seconds (about 2 to 3 seconds), the fiber is removed from the pad bath before the aqueous oxidizer solution reaches the inside of the fiber but after the epidermis is sufficiently impregnated with the aqueous oxidizer solution, and promptly the fiber is squeezed with a mangle to control the amount of the attached aqueous oxidizer solution so as to be in a specific range. The fiber thus containing a specific amount of aqueous oxidizer solution then is treated at a temperature of around 95° C. in steam to promote the pre-oxidation reaction while avoiding drying of the fiber.

Herein, the term "to pad" does not mean to immerse a fiber in a solution by merely placing the fiber in a bath but means to perform impregnation while avoiding a reaction occurring in an immersion bath in view of the chemical reactivity of the oxidizer that is used with the animal fiber. The term means to select a condition under which a reaction barely occurs, i.e., to select a wetting agent that has high penetrating ability and that is not decomposed by an oxidizer present in a bath, to suppress the reaction with the fiber by controlling the bath temperature to be as low as possible, to perform immersion for a short period of time of a few seconds, and to perform squeezing.

Step 2 in the treatment method of the present invention is a stage in which the animal fiber that has been pre-oxidized with an oxidizer is brought into a high oxidation state with ozone. Usually, ozone oxidation takes a long period of time and it has been difficult to attain an oxidation state sufficient for cleaving the cystine bond. That is, when an animal fiber is oxidized with ozone, it has been necessary to perform a treatment with highly concentrated ozone gas or ozone water for 10 to 30 minutes, and under such conditions, performing a continuous treatment was not possible. In contrast, in the present invention, pre-oxidation is performed in step 1 as a pre-treatment, and ozone is brought into a specific form and contacted with a fiber in a specific manner, thereby making it easy to attain a high oxidation state with ozone in a short period of time and making it possible to sequentially perform the treatment process.

It is preferable that in the ozone treatment, a device for preventing scattering of ultrafine bubbles is used and ultrafine bubbles discharged from a line mixer are collected on the surface of a perforated suction drum so as to increase the number of times ultrafine bubbles collide with the fiber.

When an oxidation treatment is performed with ozone in a bubble form dispersed in water, the presence of bubbles in water generally inhibits wetting of a fiber with the solution and adversely affects the permeation of the solution. In the present invention, as a means for solving this problem, a method is used in which, first, a sliver of animal fibers is sufficiently opened by a rotary gill to form a strip, the strip is wound around the surface of a perforated suction drum, ozone-oxygen mixed gas is processed into ultrafine bubbles using a line mixer, and the solution is sucked to increase the number of times the bubbles are collided against the fiber to allow the ultrafine bubbles to penetrate between the fibers, thereby promoting ozone oxidation.

The present invention shall be described in detail according to the respective steps. An animal fiber sliver to be used is, for example, a top having about 25 g/m, and 9 pieces of such a top are opened using a gill to form a strip. The draft ratio is about 1.4 to 4 and preferably 1.66 although it varies depending on the fineness of the wool. The rate of feeding the wool top is 0.2 m/min to 4 m/min and preferably 0.5 m/min to 2 m/min.

The wool top in a strip form is immersed in an aqueous solution containing an oxidizer and a wetting agent and squeezed with a mangle. Examples of oxidizers include persulfuric acid, persulfuric acid salts or acidic persulfuric acid salts such as potassium hydrogen persulfate, sodium hydrogen persulfate, ammonium persulfate, potassium persulfate and sodium persulfate, potassium permanganate, hydrogen peroxide, performic acid or salts thereof, peracetic acid or salts thereof, and the like. A particularly preferable oxidizer should be in a particle form, easily dissolve and be storage stable at 32° C. or less once dissolved in an aqueous solution, and is therefore potassium hydrogen persulfate [trade name: "Oxone" ($2KHSO_5.KHSO_4.K_2SO_4$, the active component is $KHSO_5$, 42.8 wt %), manufactured by Du Pont]. The wetting agent should be stable against the oxidizer and thus "Alcopol 650" (manufactured by Ciba Specialty Chemicals Inc.) is preferable. The concentration of oxidizer varies depending on the oxidizer, and in the case of the potassium hydrogen persulfate "Oxone", the concentration is 10 g/L to 50 g/L and preferably 20 g/L to 40 g/L if the wet pickup is 100%. The concentration of wetting agent is suitably about 2 g/L in the case of the "Alcopol 650". The temperature of the padding solution is preferably as low as possible so as not to cause a reaction in the solution. A temperature of 15° C. to 25° C. is particularly preferable. The pH of the solution preferably is on the acidic side. More preferably, the pH is 2.0.

After being squeezed with a squeezing mangle, a wool sliver is reacted with an oxidizer. The treatment conditions vary depending on the type of oxidizer. For example, in the case of potassium permanganate, hydrogen peroxide, performic acid, or peracetic acid, the sliver may be padded with an aqueous solution of such an oxidizer and then left to stand at room temperature. The duration of leaving the sliver to stand varies depending on the type and the concentration of oxidizer and it may be about 2 to 10 minutes. Also, in the case of potassium hydrogen persulfate, potassium persulfate, sodium persulfate, or ammonium persulfate, the sliver may be padded with an aqueous solution of such an oxidizer and then subjected to a steaming treatment at normal pressures to carry out the pre-oxidation reaction. The steaming conditions may include a temperature of 95° C. and a duration of 5 to 15 minutes. Preferably, pre-oxidation is sufficiently carried out with steaming of about 10 minutes.

One feature of animal fibers is that the cystine (—S—S—) content is different in each tissue that constitutes the epidermis and the cortex. In the present invention, the epidermic tissue particularly is modified so as to impart shrink resistance and piling resistance. Oxidation of the cystine bond progresses sequentially as shown below, and the —S—S— bond is not cleaved until receiving hydrolysis and a reducing treatment, eventually giving sulfonic acid ($—SO_3H$).

Formula 1

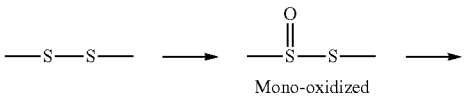

-continued

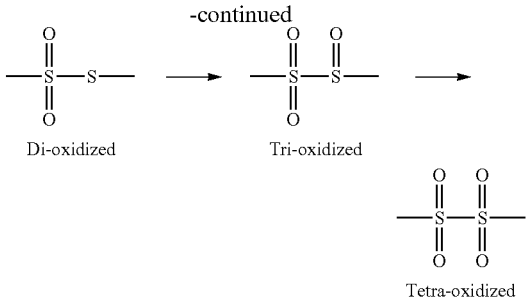

A feature of the present invention is that a reaction is carried out according to a pad-steam method using an oxidizer such as potassium hydrogen persulfate to bring the —S—S— bond substantially into only a mono-oxidation state, and the —S—S— bond further is oxidized in a subsequent step to a high oxidation state using ozone. By adopting these operations, subjecting the —S—S— bond to pre-oxidation in advance and then oxidizing the —S—S— bond with ozone, as shown in the following scheme, result in a rate of ozone oxidation reaction that is greater than the oxidation rate attained with ozone alone or potassium hydrogen persulfate alone, allowing a sequential treatment of an animal fiber sliver to be performed.

Formula 2

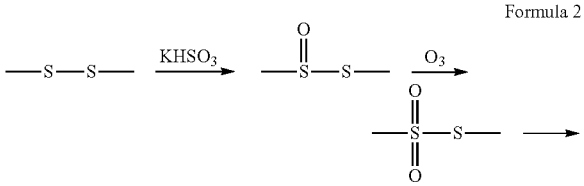

In the present invention, ozone-oxygen mixed gas is processed into ultrafine bubbles and blown in water against an animal fiber sliver for collision, thereby causing a gas phase reaction for attaining a high oxidation state. For an ozone generator, a generator that generates ozone at a rate of about 250 g/hr (for example, a generator manufactured by Chlorine Engineering Co., Ltd.) can effect a sufficient sequential treatment of an animal fiber sliver. For example, oxygen gas is supplied at a rate of 40 L/min to a generator and the generated ozone gas accounts for a weight concentration of 6.5 wt % and a volume concentration of 0.1 g/L of the mixed gas. In one example, optimum conditions included a treatment with ozone-oxygen mixed gas at 4 g/min although it varies depending on the extent of pre-oxidation and other factors. The amount of ozone supplied for imparting shrink resistance and piling resistance to a wool fiber is 6% owf or less and preferably 1.5% owf to 4% owf of the weight of wool although it varies depending on the type of wool.

To efficiently react ozone gas with wool, one feature of the present invention is to process ozone gas into as small bubbles as possible in water, allow the bubbles to collide against wool, and cause an oxidation reaction in situ. Therefore, in combination with the very poor solubility of ozone in water, only the epidermis tissue of wool is oxidized as a result, and an inner tissue, i.e., the cortical tissue, remains intact, resulting in a further enhanced surface modification effect on the wool. A method for processing ozone-oxygen mixed gas into ultrafine bubbles preferably is a method in which mixed gas is charged into a water-jet pump, the water pressure is increased, and water is propelled against the protrusions in a cylinder to give ultrafine bubbles.

Figure 2:
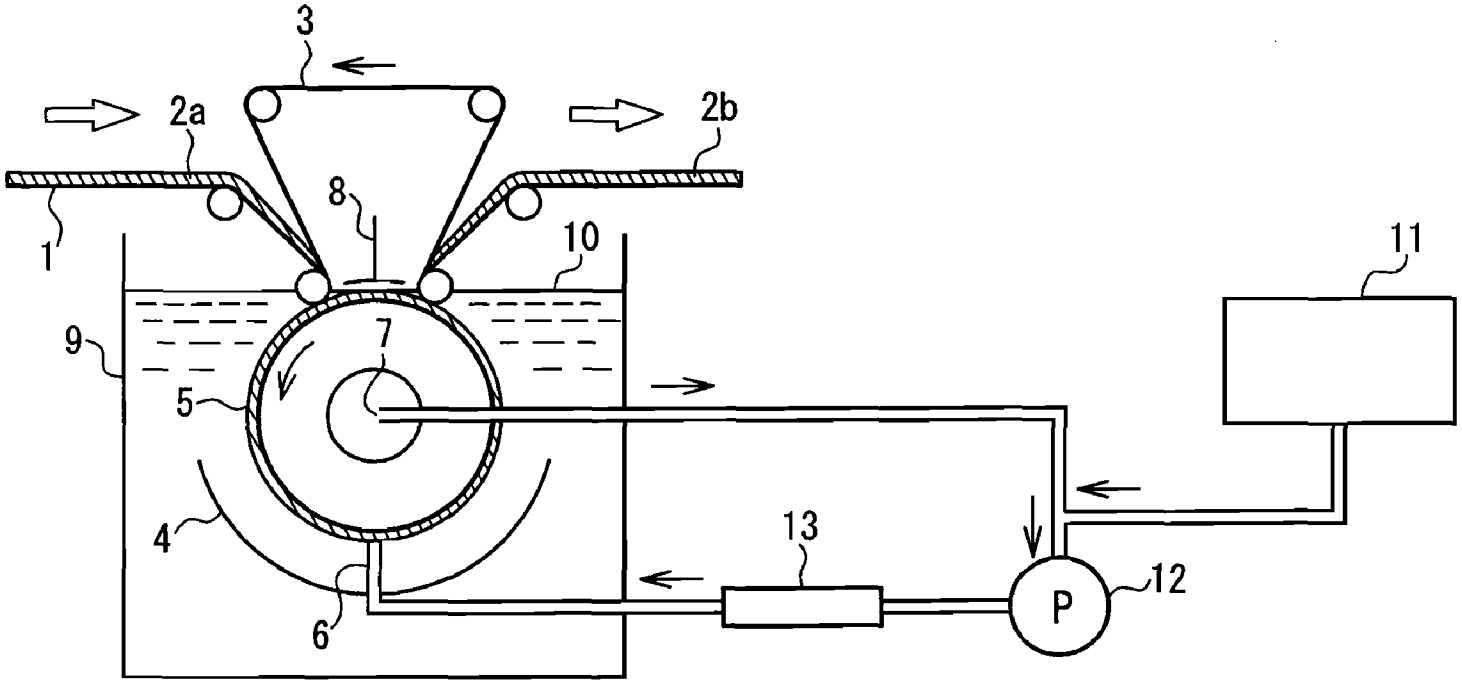
FIG. 2 is a drawing illustrating an ozone treatment method in one example of the present invention.

As shown in FIG. 2, a wool sliver (2*a*) in strip form that has undergone pre-oxidation is sandwiched between meshed stainless-steel belts (1) and (3) and fed from the surface (10) of an ozone treatment solution to an ozone treatment tank (9) equipped with a suction drum (5). Reference numeral 8 refers to a plate for preventing suction of the solution. Ozone-oxygen mixed gas produced from an ozone generator (11) is charged into a water-jet pump (12) for gas-liquid mixing, the water pressure is increased to send the mixture to a line mixer (13), and ultrafine bubbles are blown onto the wool sliver in strip form via an outlet (6) from the line mixer (13). To collect the ultrafine bubbles on the wool sliver in a strip form, a device for collecting ultrafine bubbles (4) is provided on the periphery of the suction drum and a solution that contains the ultrafine bubbles is sucked from the central part (7) of the suction drum so as to propel ultrafine bubbles against the wool sliver in a strip form. The surface layer of the wool fiber thereby is oxidized. An anionic surfactant having a $C_{8-24}$ alkyl group is added to the ozone treatment solution (aqueous solution) to microdisperse ozone. Reference numeral 2*b* refers to a wool sliver in which the surface layer of the wool fiber has been oxidized.

Although ozone is said to be the second most powerful oxidizing agent after fluorine, the properties of ozone are different when ozone is on the acidic or alkaline side. That is, on the acidic side:

$$O_3+2H^++2e^-=O_2{}^+H_2OE_o=2.07\text{ V, and}$$

on the alkaline side:

$$O_3+H_2O+2e^-=O_2+2OH^-E_o=1.24\text{ V}$$

On the acidic side, the oxidizing power is greater, the solubility of ozone in water is greater, and the half-life is significantly longer. For example, the half life is 1 second at a pH of 10.5 and 105 seconds at a pH of 2.0.

The present invention is carried out on the acidic side at pH 1.5 to pH 2.5 and more preferable conditions include pH 1.7 to pH 2.0. In cold water, ozone has high solubility but poor reactivity. The treatment temperature needs to be increased to enhance reactivity, and the temperature may be in a range of 30° C. to 50° C. Excessively high temperatures result in greater movement of molecules in the ozone-oxygen mixed gas, and the mixed gas may escape out of the treatment tank. A particularly preferable temperature is 40° C. The solution contact time (reaction time) is preferably 20 seconds to 5 minutes. The reaction time can be controlled through the rate of feeding a wool sliver, i.e., the solution contact time in the ozone treatment tank. For example, when the rate of feeding a sliver is 0.5 m/min, the contact time is 2 minutes, and when the rate is 2 m/min, the contact time is 33 seconds, and controlling the reaction time enables shrink resistance and pilling resistance to be controlled.

It is not until the wool sliver oxidized with ozone in the ozone treatment tank is treated with a reducing agent that the —S—S— bond is cleaved as shown in the following scheme.

Formula 3

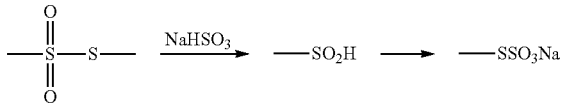

In this method, particularly the exocuticle layer B in the epidermal tissue is attacked, and consequently the cystine crosslink density is decreased and swelling caused by water is increased, exhibiting water swellability comparable to that of endocuticle. Thus, the bimetal-like properties of the animal fiber are eliminated and lifting of scales in water is prevented. Therefore, the function of repelling water, which is a feature of wool, is not lost, and high shrink resistance and pilling resistance can be imparted while water repellency is maintained.

The reducing agent is not particularly limited, and sulfurous acid salts are suitable. Among sulfurous acid salts, sodium sulfite $Na_2SO_3$ (pH 9.7) is more preferable than acidic sodium sulfite $NaHSO_3$ (pH 5.5). Since pre-oxidation and ozone oxidation are carried out on the acidic side, performing a reduction treatment on the alkaline side is preferable also from the standpoint of a neutralizing treatment. The concentration of sodium sulfite preferably is in a range of 10 g/L to 40 g/L and particularly preferably around 20 g/L. The temperature preferably is 35° C. to 45° C. and particularly preferably around 40° C.

It is preferable to carry out water washing in two steps while letting water overflow so as to remove the remaining sulfurous acid salts as well as to remove protein released from the treated wool. The temperature preferably is about 40° C.

After water washing, a softener and a spinning oil may be added to a final tank in view of the texture and the spinnability of the wool sliver. For example, 1 g/L of Alcamine CA New (manufactured by Ciba Specialty Chemicals Inc.) and 1 g/L of Croslube GCL (manufactured by Crosfields/Miki) may be added and a treatment carried out at 40° C.

It is preferable to carry out drying at a relatively low temperature of around 80° C. in a suction drier to avoid yellowing resulting from heat.

Comparison and review of various oxidation methods that are performed on animal fibers are as follows:

A. Oxidation Solely by Ozone Treatment (1) The solubility of ozone in water is extremely low, being 39.4 mg/L at 0° C., 13.9 mg/L at 25° C. and 0 mg/L at 60° C., and the treatment time is excessively long due to the low concentration and is not suitable for a successive treatment from the view point of carrying out a successive treatment of an animal fiber sliver.

(2) Large amounts of an aqueous solution in which ozone is dissolved are needed.

(3) An apparatus that generates ozone in high concentration is needed, resulting in increased capital spending.

(4) If ozone gas is used in high concentration, careful attention needs to be paid to exhaust gas and the worksite environment.

B. Comparison of Immersion Method with Pad-Steam Method for Oxidation with Potassium Hydrogen Persulfate or the Like (1) One of the side-chain bonds that are involved in stabilization of the polymer chain of an animal fiber is an ionic bond ($—NH_3^+$, $^-OOC—$). A high temperature and a long time are needed for a chemical agent such as potassium hydrogen persulfate to react in an immersion method, so the potassium ion (+), hydrogen ion (+), or persulfate ion (−) is attracted to $—NH_3^+$ or $^-OOC—$ and breaks the ionic bond as well as the —S—S— bond, thereby reducing strength, the extent of elongation, and like properties of the fiber, and thus no shrink resisting effect is obtained.

(2) In contrast, in a method where an animal fiber is oxidized solely by pad-steaming using potassium hydrogen persulfate, the padding operation step is intended practically to perform immersion under conditions where an animal fiber and potassium hydrogen persulfate do not react. Accordingly, the temperature of an aqueous solution of potassium hydrogen persulfate is lowered (a temperature at which the aqueous solution is stable: 20° C. or lower), immersion in the aqueous solution is performed for a short period of time (2 to 3 seconds) using a wetting agent at a low temperature, and squeezing with a mangle is performed immediately so as to impregnate the animal fiber with a specific amount of potassium hydrogen persulfate. Then, heat is applied to the animal fiber by steaming, thus allowing a reaction to occur only in the portions where the animal fiber is impregnated with the chemical agent. In this method, the inside of the fiber is not affected and only the surface layer is oxidized, and the inner tissue remains intact, contributing to modification of the epidermal tissue, i.e., imparting shrink resistance and pilling resistance, which is an object of the present invention.

C. Performing Ozone Treatment after Pre-Treatment with Potassium Hydrogen Persulfate or Like Oxidizer (1) An animal fiber once pre-oxidized is oxidized easily and rapidly with ozone, and the oxidation of the animal fiber completes in a short period of time, allowing a successive treatment to be performed.

(2) Since the animal fiber is pre-oxidized in advance, an oxidation reaction progresses sufficiently with ozone of a low concentration, thereby allowing a successive treatment of an animal fiber sliver to be sufficiently performed with an apparatus that generates ozone of a low concentration.

(3) Because the apparatus generates ozone of a low concentration, the work environment is not deteriorated.

(4) Because the apparatus generates ozone in a low concentration, capital spending is small.

As described above, according to the two-step oxidation method of the present invention, unexpected and effective oxidation can be attained that cannot be obtained by an oxidation treatment with either an oxidizer or ozone alone.

As described above, according to the present invention, the cystine bond is cleaved uniformly by highly oxidizing and subsequently reducing an animal fiber and, as a result, an animal fiber that has uniform shrink resistance and pilling resistance can be obtained through a sequential process. In the treated animal fiber thus obtained, the exocuticle layer B is selectively attacked and the integrated structure that includes epicuticle/exocuticle layer A, which is histologically a rigid structure, is preserved and, as a result, water-repellent eicosanoic acid is also preserved and the water repellency of the entire fiber is maintained and the fiber strength is also maintained.

In contrast, in the chlorination reaction of an animal fiber, the cystine bond is oxidized and hydrolyzed to give sulfonic acid ($—SO_3H$), and since not only is the cystine bond cleaved but also the polypeptide chain that constitutes the animal fiber is cleaved, the tensile strength and elongation of the fiber is impaired. The tissue having a thioester bond formed between eicosanoic acid and the —SH group in a polypeptide chain present in the outermost membrane of a wool fiber also is broken, converting the fiber from hydrophobic to hydrophilic. Thereby, the natural water repellency of wool is lost.

The reaction mechanism of the chlorination reaction is shown below.

Formula 4

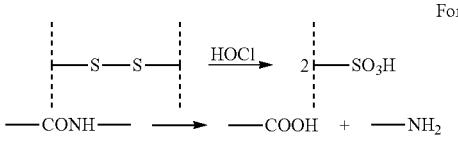

EXAMPLES

Hereinbelow, the present invention shall be described in more detail with reference to examples and comparative examples, but the present invention is not limited to the examples, and any suitable modification that conforms to the foregoing description made when reducing the present invention to practice is all encompassed within the technical scope of the invention.

Method for Measuring Shrinkage Caused by Felting

Felting shrinkage is measured according to the WMTM31 method (Woolmark Test Method 31) using a fabric knitted to have a cover factor (C.F.) of 0.41 with one line being taken from 14 gages as a test sample. Here, the phrase "according to the WMTM31 method" means that measurement was performed following the test procedure of the WMTM31 method established based on the ISO 6330 method while a Cubex shrinkage tester was used as the test washer instead.

Method for Measuring Pilling Resistance

Pilling resistance can be quantitatively expressed using a pilling test according to JIS L 1076.6.1A, and a fabric having a pilling grade of 3 or greater is regarded as piling resistant. The pilling test using the foregoing criterion is carried out under the following conditions.

(1) Tester: ICI tester (2) Knitted fabric: fabric knitted with 1P18G was used.

Method for Measuring Water Repellency

Water repellency is evaluated according to the permeation of a droplet dripped onto the knitted fabric made of an animal fiber. The evaluation criteria are as follows.

A: The droplet remains on the fabric after a lapse of 30 minutes (comparable to natural animal fibers).

B: Almost all the droplet permeates the fabric in 2 to 30 minutes.

C: Almost all the droplet permeates the fabric in less than 2 minutes.

Note that water repellency may be evaluated through placing a test sample that is in sliver form on the surface of water and measuring the time until the sliver submerges under water by absorbing water. A droplet remains on the animal fiber of the present invention after a lapse of 30 minutes as with natural animal fibers.

Example 1

Figure 3:
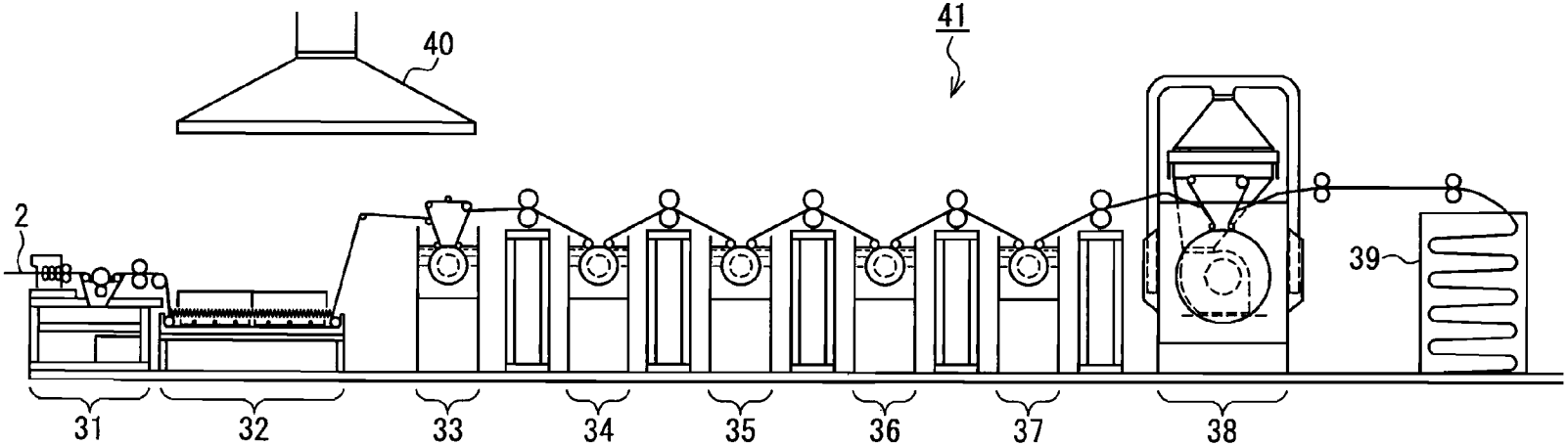
FIG. 3 is an explanatory side view of a processing unit in one example of the present invention.

A wool sliver 2 was treated successively using a processing unit 41 shown in FIG. 3. In the processing unit 41, a padding treatment tank 31, a steam treatment device 32, an ozone treatment tank 33, a reduction treatment tank 34, a first water washing treatment tank 35, a second water washing treatment tank 36, a lubricant applicator 37, a dryer 38, and a storage container 39 were connected, and the travel speed of the sliver 2 was at 2 m/min. Reference number 40 refers to a duct disposed above the steam treatment device 32 and the ozone treatment tank 33. In FIG. 3, step 1 of the present invention is carried out in the padding treatment tank 31 and the steam treatment device 32, step 2 is carried out in the ozone treatment tank 33, and step 3 is carried out in the reduction treatment tank 34. In the examples below, the treatment carried out in the padding treatment tank 31 will be referred to as a "padding treatment step."

Padding Treatment Step (1) Raw Wool Material:

Nine pieces of a sliver (25 g/m) of 20.7 μm Australian merino wool were supplied to a rotary gill, and the wool sliver was opened into strip form by drafting it 1.66 fold. The sliver in strip form was padded in an aqueous solution having the composition shown below and pressed with a mangle.

(2) Composition of Aqueous Padding Solution:

Potassium hydrogen persulfate $KHSO_5$ at a concentration of 40 g/L ("Oxone" manufactured by Du Pont), wetting agent "Alcopol 650" at a concentration of 2 g/L (manufactured by Ciba Specialty Chemicals Inc.)

(3) Treatment Conditions:

Contact time: 2 seconds

Temperature: room temperature (25° C.)

pH: 2.0

Pick up: 100%

After being squeezed with a mangle, the sliver was transferred to the steam treatment step.

Steam Treatment Step

The wetted wool sliver in a strip form was subjected to a steam treatment on a conveyor net under the following conditions. 10-minute steam treatment at 95° C., after which the sliver was transferred to an ozone treatment tank.

Ozone Treatment Step

The steam-treated sliver was transferred to a uction-type ozone treatment tank and oxidized with ozone under the following conditions.

(1) 250 g/hr, Ozonizer ("OZAT CFS-3", manufactured by Chlorine Engineering Co., Ltd.) was used and an oxygen tank was used as an oxygen source.

(2) The generated ozone gas was transferred to 4 line mixers through 4 pumps having a pumpage of 80 L/min, respectively. The line mixers each blow ozone in an amount of 10 L/min, totaling 40 L/min. A device for preventing scattering of ultrafine bubbles as shown in FIG. 2 was used in blowing ultrafine bubbles to collide them against on the wool sliver on the suction drum. Moreover, to increase the number of times the bubbles are collided, the treatment solution was sucked from inside of the drum so that the bubbles moved around the drum. The ozone treatment was carried out under the following conditions.

(3) Ozone bubbles: ultrafine bubbles having a diameter of 0.5 to 3 μm (the diameter of ozone bubbles was measured using a laser diffraction/scattering method, and it indicated that 90% or greater of the bubbles had that diameter.)

(4) The surfactants shown in Table 1 each were added in an amount of 0.1 wt % to the aqueous ozone treatment solution.

(5) Treatment temperature: 40° C.

(6) pH: 1.7 (adjusted with sulfuric acid)

(7) Contact time: 33 seconds (8) After ozone treatment, the sliver was transferred to the reduction tank.

Reduction Treatment Step

The ozone-treated sliver in strip form was treated under the following conditions in a suction-type reduction treatment tank.

(1) 20 g/L of sodium sulfite $Na_2SO_3$ (2) pH: 9.7

(3) Temperature: 40° C.

(4) Contact time: 33 seconds (5) After reduction treatment, the sliver was transferred to the water washing tank.

First Water Washing Treatment Step

The sliver in strip form that had undergone a reduction treatment was treated with warm water at 40° C. for 33 seconds in a suction-type water washing tank. After water washing, the sliver further was transferred to a water washing treatment tank.

After water washing, the sliver was transferred to the final tank to apply to the sliver spinning oil and a softener that are necessary in the subsequent steps.

Lubricant Treatment Step

The sliver in strip form that had been washed with water was treated with warm water at 40° C. for 33 seconds in a suction-type treatment tank charged with the following spinning oil and softener. Treatment agent: "Alcamine CA New" (manufactured by Ciba Specialty Chemicals Inc.) at a concentration of 1 g/L and "Croslube GCL" (manufactured by Crosfields/Miki) at a concentration of 1 g/L. After lubricant treatment, the sliver was transferred to a drier.

Drying Step

Drying was carried out at 80° C. using a suction-type hot-air drier.

The treated sliver in strip form was placed in a storage container and then gilled and spun into a 2/48 Nm knitting yarn having a twist of Z500×S300. After examining the strength and the extent of elongation of the yarn, the yarn was knitted into a fabric having a density corresponding to a cover factor C.F. of 0.41 and washed continuously for 1 hour and 3 hours with a Cubex washing tester. Furthermore, the fabric knitted to have a C.F. of 0.41 was subjected to a pilling test for 5 hours using an ICI pilling tester. To further investigate the properties of the treated wool fiber, the wool surface was inspected visually with an electron microscope Hitachi S-3500N. To investigate the water repellency of treated wools, slivers were gilled and opened, and 1 g each of treated slivers and an untreated sliver were sampled. The samples were placed on the surface of water in a 1 L beaker containing 800 mL of distilled water, and watched to see whether the samples would submerge. The results of the samples are shown in Table 1.

TABLE 1

| | | | Knitting yarn | | Knitted fabric | | | | | Water | | |
|---|---|---|---|---|---|---|---|---|---|---|---|---|
| | | | | | Felting shrinkage test (Cubex) | | | | | | | |
| Test example | Amount of surfactant (wt %) | Diameter of ozone bubbles (μm) | having 2/48 Nm, Z5005 × S300 Strength (gf) | Elongation (%) | 1 Hr (area %) | 3 Hr (area %) | 5 Hr (area %) | 10 Hr (area %) | Pilling test (ICI) 5 Hr (grade) | repellency test (submersion method) | Whiteness | Texture |
| 1-1* | Not added (0) | approx. 5 | 266.8 | 11.9 | 0.49 | 0.99 | −5.65 | −15.23 | 4 | A: Comparable to natural wool | White | Soft |
| 1-2 | $C_8H_{17}OSO_3Na$ (0.1) | 0.5-2 | 263.2 | 11.9 | 0.86 | 0.95 | −2.16 | −3.52 | 4 | A: Comparable to natural wool | White | Soft |
| 1-3 | $C_{18}H_{37}OSO_3Na$ (0.1) | 1-3 | 260.2 | 11.5 | 0.56 | −1.12 | −2.62 | −4.23 | 4 | A: Comparable to natural wool | White | Soft |
| 1-4 | $C_{12}H_{25}(C_6H_4)SO_3Na$ (0.1) | 1-3 | 273.5 | 12.3 | −1.65 | −3.65 | −6.82 | −9.66 | 4 | A: Comparable to natural wool | White | Soft |
| 1-5 | $C_{12}H_{25}OSO_3Na$ (0.1) | 0.5-2 | 260.6 | 11.2 | 0.26 | 1.05 | −2.23 | −2.16 | 4 | A: Comparable to natural wool | White | Soft |
| 1-6* | $C_{12}H_{25}N(CH_3)_3Cl$ (0.1) | 3-5 | 291.3 | 13.6 | −3.26 | −6.21 | −9.33 | −19.67 | 3 | A: Comparable to natural wool | White | Soft |
| 1.7* | $C_{12}H_{25}N(CH_3)_2CH_2COO$ (0.1) | 3-5 | 280.6 | 13.2 | −2.11 | −2.68 | −5.85 | −14.36 | 3-4 | A: Comparable to natural wool | White | Soft |
| 1-8* | $C_{12}H_{25}O(CH_2CH_2O)_8H$ (0.1) | 1-3 | 275.6 | 12.1 | −2.26 | −4.11 | −8.36 | −15.21 | 3-4 | A: Comparable to natural wool | White | Soft |
| 1-9* | $C_9H_{19}(C_6H_4)O(CH_2CH_2O)_8H$ (0.1) | 1-3 | 289.2 | 13.3 | −2.33 | −4.69 | −7.15 | −16.87 | 3 | A: Comparable to natural wool | White | Soft |

*Comparative Examples

The wool slivers of the example of the present invention (experiment numbers 1-2 to 1-5) were soft and appeared white, and the shrink resistance determined according to the WMTM31 method satisfied the area shrinkage standards for, washing machines that is Woolmark certified. Specifically, through a method in which spun yarns of Table 1 were prepared using the wool slivers of experiment numbers 1-2 to 1-5, pieces of fabric knitted to have a cover factor C.F. of 0.41 with one line being taken from 14 gages were used as test samples, and felting shrinkage was measured according to the WMTM31 method (Woolmark Test Method 31) established based on the ISO 6330 method except that a Cubex shrinkage tester was used in place of the test washer, it was confirmed that felting after 10 hours of testing was no more than 10 area %. If a fabric exhibits a felting of no more than 10 area % after 10 hours of testing in this measurement method, the shrink resistance thereof determined according to the WMTM 31 method satisfies the area shrinkage standards for washing machines carrying a Woolmark. The foregoing spun yarns exhibited a grade 4 pilling resistance in an ICI pilling test. One gram of a sample was visually inspected for submersion. While the untreated wool and the ozone-treated wool did not submerge after being left to stand all day and all night and stayed on the surface of water in a beaker, the wool treated according to a chlorinated resin method (chlorine/Hercosett method) submerged below the surface of water in the beaker after being left to stand for only 2 to 3 minutes. One feature of animal fibers is that they are naturally water repellent, and the obtained results showed that the present invention can impart shrink resistance to natural wool without impairing the water repellency thereof.

In contrast, in experimental example 1-1 where a surfactant was not used, the felting shrinkage after 5 hours onward increased. In a mainstream method among conventional shrink proofing methods, the wool surface is treated with chlorine and coated with a Hercosett resin (polyamide epichlorohydrin). Therefore, although shrink resistance is obtained, water repellency is lost and the wool is easily wetted and, because of the high heat conductivity of water, the body temperature of a person who wears the wool may be decreased, creating a cold sensation. The surface of the treated wool was inspected visually using a Hitachi S-3500N electron microscope that allowed wet wool to be inspected. The scales of the wool were not open, that is, there was no differential frictional effect (D.F.E) while in the untreated wool, the scales of the wool were opened by water that wetted the wool, resulting in felting. Therefore, the products of the example were shrink-proofed to prevent the scales of wool lifting up in water.

In the comparative example (experiment numbers 1-6 to 1-9), a cationic surfactant, an ampholytic surfactant, and a nonionic surfactant were used, and the results of the felting shrinkage test and the pilling test were inferior to those of the products of the example.

Example 2

An experiment was carried out in the same manner as in example 1 except that the surfactant added to the ozone treatment solution was sodium dodecyl sulfate ($C_{12}H_{25}OSO_3Na$, SDS) and the amount of surfactant was different as well. The results are shown in Table 2.

TABLE 2

| | | | Knitting yarn | | Knitted fabric | | | | | | | |
|---|---|---|---|---|---|---|---|---|---|---|---|---|
| | Amount of | Diameter of ozone | having 2/48 Nm. Z500 × S300 | | Felting shrinkage test (Cubex) | | | | Pilling test (ICI) | Water repellency test | | |
| Test examples | surfactant (wt %) | bubbles (μm) | Strength (gf) | Elongation (%) | 1Hr (area %) | 3 Hr (area %) | 5 Hr (area %) | 10 Hr (area %) | 5 Hr (grade) | (submersion method) | Whiteness | Texture |
| 2-1* | 0 | approx. 5 | 266.8 | 11.9 | 0.49 | 0.99 | −5.65 | −15.23 | 4 | A: Comparable to natural wool | White | Soft |
| 2-2 | 0.01 | 1-3 | 260.3 | 11.9 | 0.85 | 0.03 | −2.99 | −4.21 | 4 | A: Comparable to natural wool | White | Soft |
| 2-3 | 0.1 | 0.5-9 | 260.6 | 11.5 | 0.26 | −1.05 | −2.23 | −2.16 | 4 | A: Comparable to natural wool | White | Soft |

*Comparative example
SDS stands for sodium dodecyl sulfate ($C_{12}H_{25}OSO_3Na$).

As shown in Table 2, with sodium dodecyl sulfate ($C_{12}H_{25}OSO_3Na$, SDS) added in an amount within a range of 0.01 to 0.1 wt %, ultrafine bubbles of ozone can be made, and felting shrinkage after 5 hours onward was minimal.

DESCRIPTION OF REFERENCE NUMERALS

1. Mesh belt of ozone treatment device (outer belt)
2. Wool sliver
2*a*. Wool sliver that has been subjected to a pre-oxidation treatment
2*b*. Wool sliver in which the surface layer of wool fiber has been oxidized
3. Mesh belt of ozone treatment device (inner belt)
4. Drum cover of ozone treatment device (device for preventing scattering of ultrafine bubbles)
5. Suction drum of ozone treatment device
6. Outlet of solution containing ozone-oxygen mixed gas
7. Inlet
8. Plate for preventing sucking a solution
9. Ozone treatment tank
10. Solution surface of ozone treatment solution
11. Ozone generator
12. Circulation pump for ozone-oxygen mixed gas-containing solution
13. Line mixer
21. Epicuticle layer
22. Exocuticle layer A
23. Exocuticle layer B

24. Endocuticle layer
25. Intercellular cement
31. Padding treatment tank.
32. Steam treatment device
33. Ozone treatment tank
34. Reduction treatment tank
35. First water washing treatment tank
36. Second water washing treatment tank
37. Lubricant applicator
38. Drier
39. Storage container
40. Duct
41. Processing Unit

The invention claimed is:

1. A method for producing a modified wool fiber, comprising:

step 1 of pre-oxidizing a cystine bond (—S—S— bond) present in an epidermal cell of an wool fiber so that the cystine bond is in a low oxidation state, step 2 of oxidizing with ozone the pre-oxidized —S—S— bond so that the —S—S— bond is in at least one high oxidation state selected from di-, tri-, and tetra-oxidation states, and step 3 of reductively cleaving the —S—S— bond that is in a high oxidation state, wherein the method imparts shrink resistance and pilling resistance to the wool fiber, wherein an area shrinkage of the wool fiber is 10% or less at a 10-hour value, and wherein in the step 2, ozone is microdispersed as a bubble in an aqueous solution that comprises an anionic sulfate surfactant having a $C_{8-18}$ alkyl group, and the wool fiber is contacted with the ozone, the anionic sulfate surfactant is present in an amount ranging from 0.01 to 0.1 wt% in the aqueous solution, the bubble of the ozone has a diameter ranging from 0.5 to 3μm, and the ozone is supplied in an apparent amount ranging from 1.5 to 4% owf to the wool fiber.

2. The method for producing a modified wool fiber according to claim 1, wherein the surfactant is an anionic sulfate surfactant comprising at one alkali metal salt of a sulfuric acid ester of an alcohol, R—O—SO3, wherein R is a C8-C18 alkyl group.

3. The method for producing a modified wool fiber according to claim 1, wherein the surfactant is sodium dodecyl sulfate ($C_{12}H_{25}OSO_3Na$).

4. The method for producing a modified wool fiber according to claim 1, wherein a surface layer of the wool fiber is oxidized by contacting the wool fiber with the ozone.

5. The method for producing a modified wool fiber according to claim 1, wherein the wool fiber is contacted with the ozone under conditions where the aqueous solution in which the ozone is microdispersed is on an acidic side with pH being 1.5 to 2.5.

6. The method for producing a modified wool fiber according to claim 1, wherein the wool fiber is contacted with the ozone under conditions where a temperature range is 30 to 50° C.

7. The method for producing a modified wool fiber according to claim 1, wherein the wool fiber is contacted with the ozone under conditions where a solution contact time is 20 seconds to 5 minutes.

* * * * *